United States Patent [19]

Gagnon

[11] 3,945,089

[45] Mar. 23, 1976

[54] SECURING DEVICE

[76] Inventor: Kenneth M. Gagnon, 302 Reservoir Ave., Lincoln, R.I. 02865

[22] Filed: Jan. 20, 1975

[21] Appl. No.: 542,436

[52] U.S. Cl. ..... 24/155 SD; 63/12

[51] Int. Cl.[2] ..... A44B 9/00; A44C 7/00

[58] Field of Search ..... 24/49 P, 155 SD, 90 PR; 63/12

[56] References Cited

UNITED STATES PATENTS

| | | | |
|---|---|---|---|
| 320,991 | 6/1885 | Westcott | 63/12 UX |
| 958,404 | 5/1910 | Jameson | 24/155 SD |
| 1,358,465 | 11/1920 | Reston | 24/49 P |
| 1,372,449 | 3/1921 | Pollard | 24/90 PR |
| 2,769,322 | 11/1956 | Czuch | 63/12 |
| 3,087,215 | 4/1963 | Tworek et al. | 24/90 PR |
| 3,534,446 | 10/1970 | Silver | 24/90 PR |

FOREIGN PATENTS OR APPLICATIONS

| | | | |
|---|---|---|---|
| 417,230 | 8/1910 | France | 24/155 SD |
| 837,328 | 4/1952 | Germany | 63/12 |
| 4,502 | 12/1905 | United Kingdom | 24/155 SD |

*Primary Examiner*—Donald A. Griffin
*Attorney, Agent, or Firm*—Barlow & Barlow

[57] ABSTRACT

A securing device is disclosed which is usable for studs of buttons, emblems, earrings or insignia or the like, which comprises two parts, one part having a cylindrical stud extending therefrom, and a second part into which the stud may pass and which includes a resilient clutch that grips a substantial length of the cylindrical stud.

1 Claim, 4 Drawing Figures

SECURING DEVICE

BACKGROUND OF THE INVENTION

Securing devices utilizing clutches have long been known and have taken a variety of forms for gripping posts or studs or the like. Generally these devices comprise arrangements wherein a plurality of fingers will grip the stud such as, for instance, in the Ruggles U.S. Pat. No. 19,305 or the Marshall U.S. Pat. No. 1,664,566. More modern arrangements where plate-like devices act as spring clutches are disclosed in such patents as Ballou U.S. Pat. No. 2,308,412. Devices of this general nature utilize a clutch device which is much larger in diameter than is sometimes needed for the application. Further devices of this nature do not lend themselves to being easily molded into plastic parts where it is normal to cast plastic about a stud but to cast about the clutch device has not been feasible.

SUMMARY OF THE INVENTION

The instant invention relates to a two-part securing device, one part having a stud extending therefrom and a second part having a clutch means with a central opening in the clutch means into which the stud may pass and be gripped therein. The device lends itself to having a variety of configurations molded about the clutch and the stud such as matching balls for earrings or tie tack elements or lapel buttons or the like. The arrangement is such that the stud will have a diameter slightly larger than the entrance diameter of the resilient clutch. Further the resilient clutch which may be molded from rubber or any one of the synthetic rubbers will be provided with a body having a larger mass near the entrance where the stud will enter the opening than near the rear part of the central opening so that different degrees of resiliency can be experienced throughout the length of the central opening which grips the stud.

DESCRIPTION OF THE PREFERRED EMBODIMENT

Figure 1:
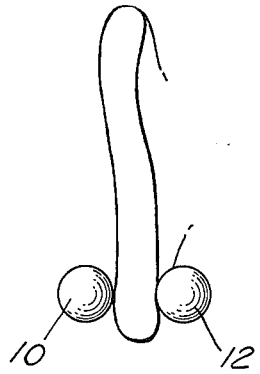
FIG. 1 is a perspective view looking at the rear edge of an ear showing the devices of the invention utilized as an earring with ball ends.
Figure 2:
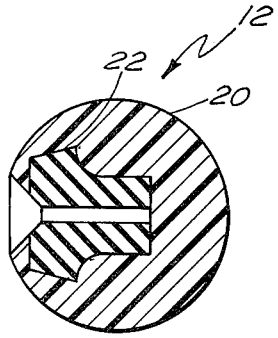
FIG. 2 is a cross sectional view of the part having the resilient clutch.

In proceeding with the invention, I provide two parts 10 and 12. The first part 10 has a shank 14 extending therefrom, the shank being suitably secured in the enlarged part portion 10 either having the same molded thereon or therein or alternately the shank may be suitably staked or driven or otherwise secured to the first part 10. Shank 14 preferably has a chamfered end 16 and is cylindrical having a diameter 18 as indicated by the arrows so designated. The shank may be of a variety of materials for the use intended, a 14-karat gold being desirable for pierced earring use. With a first part construction of this nature in which the shank extends from the part 10 it is necessary that there be a second part cooperating therewith which should preferably protect the extending shank from abrading the skin of the wearer if the securing device be used as an earring as illustrated in FIG. 1 or the clothing, if the device is utilized as a button back.

Figure 3:
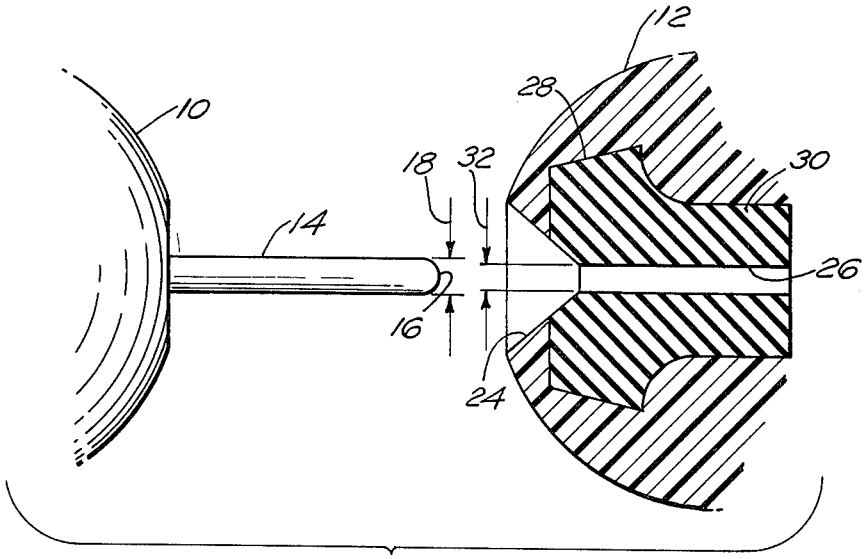
FIG. 3 is a detached view of the stud part and clutch part in enlarged partial cross section.
Figure 4:
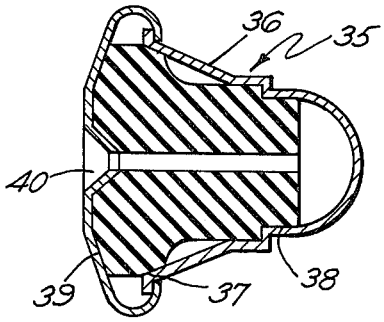
FIG. 4 is a sectional view of a modified form.

To this end, I therefore provide a second part 20 which has a clutch member 22 received therein. In the form as illustrated in FIG. 3 the clutch member 22 is molded within the body of the second part 20 and held in place by contact with the surfaces of the part 20 about it and has a chamfered opening 24 leading to the clutch member 22. The clutch member 22 is preferably a resilient member in the form of a synthetic rubber such as, for example, a copolymer of styrene and butadiene. This is basically a thermoplastic that exhibits physical properties which are essentially indistinguishable from a vulcanized elastomer and may be readily formed like any thermoplastic by molding the same into a specific shape. One essential property is "memory". The thermoplastic material preferably has a Shore hardness in the range of 60 to 90, a preferable hardness being in the range of 70 to 75.

The resilient clutch member essentially substantially solid and has a central opening 26 extending therethrough with two cross sectional body sections 28 and 30 which, as viewed in section as seen in FIG. 3, is somewhat T shaped. The larger cross sectional area adjacent the entry point of the central opening 26 as at 28 is much larger than the cross sectional shape of the portion 30. In this fashion with an enlarged body section adjacent the opening there is more resistance to deformation as the stud 14 enters the central opening. To insure gripping, the clutch member should have a central opening dimension as indicated by the arrows 32 from approximately 1 to 2 thousandths of an inch smaller (0.02 to 0.04mm) and some preferred sizes are, for example, utilization of the stud 14 having a diameter of 0.027 inch (0.69mm) and an opening 26 diameter of 0.026 inch (0.67mm).

It will be apparent in use that if the device has an application as an earring as illustrated in FIG. 1, that the part 10 with the stud 14 will be passed through the aperture in the ear lobe and then the second part 12 may be brought into engagement with the stud 14 by having the chamfered portion lead the stud into the central opening 26 of the clutch where the same will hold and grip the outer surface of the stud 14.

The clutch member of this invention lends itself to injection molding and further lends itself to being integrated into a plastic part by being molded therein. For example, the parts 10 and 12 may be a styrene plastic. Further, the nature of the elements making up the combination is such that they will withstand autoclave sterilization techniques.

In some cases a metal casing 35 may be formed about the clutch in the shape shown with wall portions 36 engaging the clutch at 37, 38, 39 to hold it in place and provide an entrance mouth 40.

I claim:

1. A two-part securing device comprising a first part having a cylindrical stud extending therefrom, a second part into which the stud may pass, said second part having a hollow cap portion, a resilient clutch gripped in the hollow cap, said clutch having a central opening therethrough of substantial length flared at one end, the cross sectional area of the opening being less than the cross sectional area of the stud, said stud having a chamfered end to permit entry to the flared end of said opening, said clutch having a body section of at least two thickness, that extend radially outward from the opening, the greater thickness being positioned in the cap portion at the flared end of said opening at the outer face and the lesser thickness being inwardly of the cap and wherein the clutch is integrally molded and grippingly secured in a mass of solid plastic of the cap portion.

* * * * *